United States Patent [19]

Shimoda et al.

[11] Patent Number: 4,858,510

[45] Date of Patent: Aug. 22, 1989

[54] RESONANT MUSICAL INSTRUMENTS

[75] Inventors: Isao Shimoda; Mitsugu Yaguchi; Junji Fujii, all of Hamamatsu, Japan

[73] Assignee: Yamaha Corporation, Japan

[21] Appl. No.: 202,118

[22] Filed: Jun. 2, 1988

[30] Foreign Application Priority Data

| | | | |
|---|---|---|---|
| Jun. 5, 1987 | [JP] | Japan | 62-141868 |
| Aug. 26, 1987 | [JP] | Japan | 62-211803 |
| Nov. 2, 1987 | [JP] | Japan | 62-168811[U] |
| Nov. 30, 1987 | [JP] | Japan | 62-303888 |

[51] Int. Cl.[4] ..... G10D 13/02

[52] U.S. Cl. ..... 84/402; 84/411 R; 84/418

[58] Field of Search ..... 84/330, 332, 377, 411 R, 84/418, 402, 410

[56] References Cited

U.S. PATENT DOCUMENTS

| | | | |
|---|---|---|---|
| 1,293,723 | 2/1919 | Deagan | 84/410 |
| 2,414,656 | 1/1947 | Miller | 84/410 X |
| 2,555,833 | 6/1951 | Vanaman | 84/330 |
| 2,815,693 | 12/1957 | Mast | 84/377 |
| 3,094,890 | 6/1963 | Schoenstein | 84/332 |
| 3,657,465 | 4/1972 | Koishikawa | 84/418 |
| 3,675,528 | 7/1972 | Brick | 84/418 |
| 3,908,505 | 9/1975 | Ono | 84/83 |
| 4,214,504 | 7/1980 | Rex | 84/411 R |
| 4,269,105 | 5/1981 | Salmon | 84/402 |
| 4,688,462 | 8/1987 | Greenspoon et al. | 84/418 |

FOREIGN PATENT DOCUMENTS 0044626 6/1981 European Pat. Off. .

*Primary Examiner*—Lawrence R. Franklin

*Attorney, Agent, or Firm*—Lerner, David, Littenberg, Krumholz & Mentlik

[57] ABSTRACT

A musical instrument such as a jingle, a tambourine or a tomtom is provided with two or more hollow resonators arranged in the vicinity of at least one tone generator such as a pair of jingle discs or a head and preferably selectively closable by means of a slider coupled movably to the body of the instrument. Presence of a plurality of resonators, preferably different in resonance characteristics, assures colorful and rich resonance of tones generated by the tone generator and use of the slider enables easy and free finger control on the mode of resonance.

5 Claims, 6 Drawing Sheets

RESONANT MUSICAL INSTRUMENTS

BACKGROUND OF THE INVENTION

The present invention relates to a small musical instrument, and more particularly relates to an improvement in resonance of a musical instrument such as an idiophone and a membranophone.

As idiophones, jingles are known in general. In construction of a jingle, a number of bells are attached on the periphery of a hemicyclic shell whose ends are connected to each other by a holder for manual handling. In another example of a jingle, a number of bells are attached in lines to an elongated shell having a holder for manual handling. A tambourine jingle includes a circular shell, a number of metallic jingles attached circumferentially to the shell and a holder diametrically attached to the circular shell for manual handling. These idiophones all generate musical tones when shaken by the player's hand.

With these constructions of the conventional idiophones, no substantial resonance occurs on the shells in response to vibrations of the tone generators such as the bells and jingles. In other words, no special consideration is paid for development of resonance in production of the conventional idiophones. As a consequence, tone volume of musical tones generated is directly influenced by the vibration of the shell only and no development of echo can be expected.

In the general construction of membranophones such as tomtoms, tambourines and drums, one end of a cylindrical stem is closed by a membranous head made of leather or synthetic resin. Several jingles are attached to the shell in some examples.

In this case also, the shell is poorly resonant in response to vibrations of the head. Some resonance is present in the case of a drum in which air in the space defined by its stem vibrates more or less in response to the vibration of the head. This resonance is close in type to air column resonance and is added to the elastic vibration of the stem itself. This type of resonance naturally requires increased length of the cylindrical stem in order to have sufficient echo in performance and is rather unsuited for percussion musical instruments.

An improvement is proposed in Japanese Patent Application Sho. 62-54476 filed on Mar. 9, 1985. The proposed percussive musical instrument includes a body, a head attached to the body and a hollow resonator box attached to the body and having an opening directed towards the head. Appreciable resonance can be developed without enlarging the construction. However, one cannot expect rich resonance in response to a wide variety of musical tones. That is, the resonator box is resonant in response to a limited number of tones.

Another improvement is proposed in U.S. Pat. No. 4,668,462 in relation to a monkey tambourine. This tambourine includes a small ring-shaped shell carrying a number of metallic jingles and a hollow resonator box formed on the shell and effecting internal resonant oscillation of tones generated by the jingles. The resonator box has a curved face for manual handling and an elongated slot is formed in the curved face. During performance, the slot is fully or locally closed by player's fingers for selective generation of musical tones of different pitches.

With this proposed construction, only one resonator box is formed on the shell with a slot for finger control. As a consequence, control of tonal pitch is limited to a very narrow range and the degree of tone amplification is limited too. A high degree of technique is additionally necessary for correct and subtle control of tonal pitch.

SUMMARY OF THE INVENTION

It is the basic object of the present invention to improve resonant characteristics on musical instruments such as idiophones and membranophones.

It is another object of the present invention to enable easy and wise range control of pitch of musical tones generated by musical instruments such as idiophones and membranophones.

In accordance with the basic aspect of the present invention, at least one tone generator is coupled to a body of a musical instrument and a plurality of resonators arranged in the vicinity of the tone generator.

DESCRIPTION OF THE PREFERRED EMBODIMENT

Figure 1:
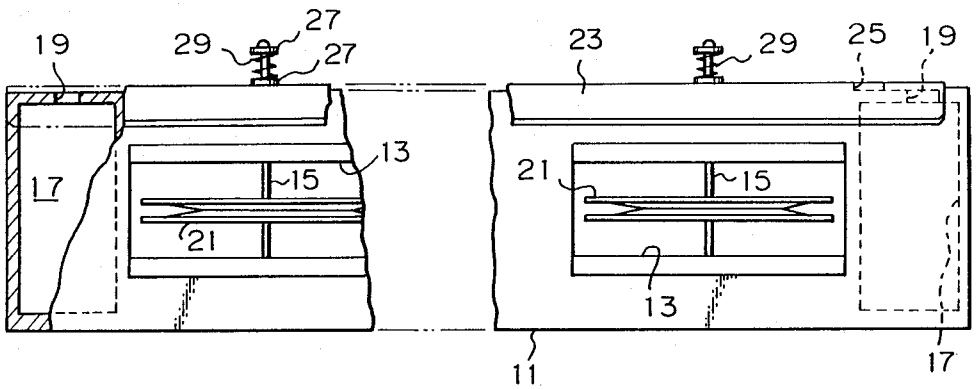
FIG. 1 is a side view partly in section, of the first embodiment of the musical instrument in accordance with the present invention directed to a stick-type jingle.
Figure 2:
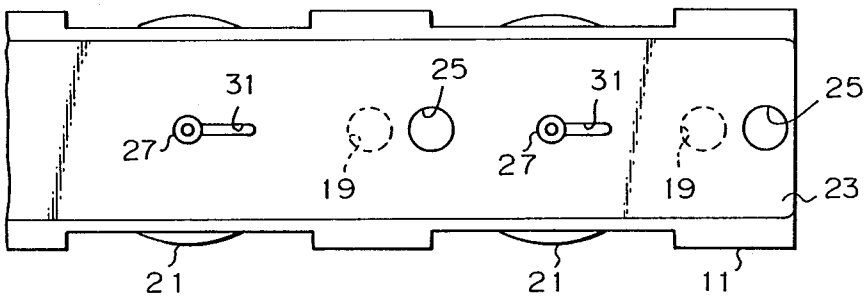
FIG. 2 is a plan view of the jingle shown in FIG. 1.

One embodiment of the musical instrument in accordance with the present invention directed to a stick-type jingle is shown in FIGS. 1 and 2, in which an elongated body 11 is provided with a number of recesses 13 aligned and spaced from each other in its longitudinal direction. In each recess 13, a pair of thin, metallic discs 21 are held together by a transverse fixed pin 15.

In the vicinity of each recess 13, a space 17 of a specified capacity is formed in the body 11 and each space 17 is provided with an opening 19 for communication with the outside air. Each opening 19 has a specified transverse cross-sectional area and opens in a specified face of the body 11. Here, the space 17 paired with the opening 19 forms a sort of Helmholtz's resonator.

Further, each opening 19 is associated with a slider 23 slidably arranged on the outer face of the body 11. As shown in FIG. 2, the slider 23 is provided with spaced openings 25 each having a cross-sectional surface area equal to that of the opening 19. The distance between adjacent openings 25 is equal to that between adjacent openings 19. One end of the fixed pin 15 extends outside the body 11 through a slot 31 formed in the slider 23. This exposed end of the pin 15 carries a pair of retainers 27 and a compression spring 29 interposed between the retainers 27 presses the slider 23 against the outer face of the body 11. Though not clearly illustrated, the slider 23 is provided with one or more knobs for easy manual operation.

Thus, the slider 23 is movable in the longitudinal direction of the body 11. When the slider 23 is moved to a position whereat the openings 25 in the slider 23 fully align with the opening 19 in the body 11, the spaces 17 fully communicate with the outside air. As the body 11 is manually shaken, the discs 21 generate tones and each space 17 paired with an opening 19 operates as a Helmholtz's resonator for development of rich echo. When the slider 23 is moved to another position whereat the opening 19 in the body 11 are partly or fully closed by the slider 23, a musical tone of different tone volume and/or tone colour is generated. As a consequence, presence and degree of resonance of the musical instrument can be freely and broadly adjusted by properly choosing the position of the slider 23 on the body 11.

Figure 3:
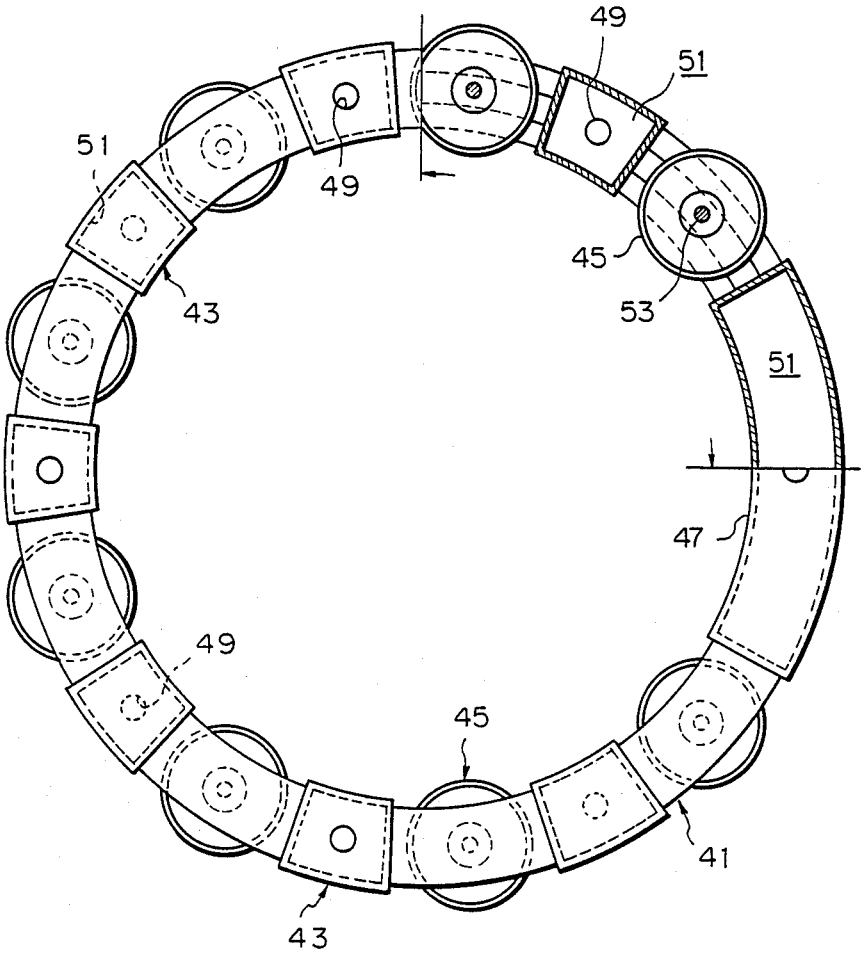
FIG. 3 is a plan view of the second embodiment of the musical instrument in accordance with the present invention directed to a circular jingle.
Figure 4:
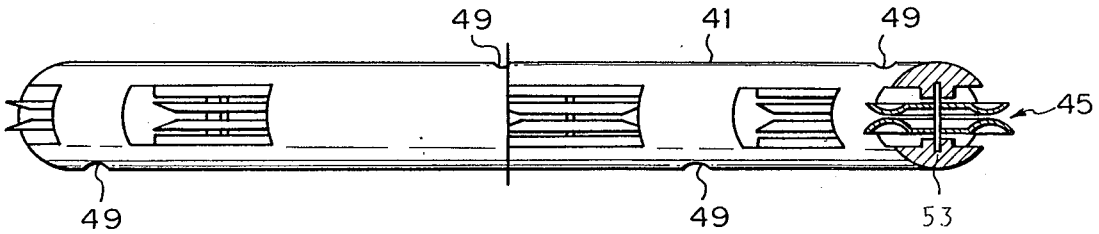
FIG. 4 is a side view, partly in section, of the jingle shown in FIG. 3, FIGS. 5 to 7 are plan views of the third to fifth embodiments of the musical instruments in accordance with the present invention directed to a stick-type jingle.

Another embodiment of the musical instrument in accordance with the present invention directed to a ring-type jingle is shown in FIGS. 3 and 4. The jingle includes a circular body 41 and a number of spaced tone generators 45 arranged circumferentially on the body 41. A holder 47 is also formed locally on the body. The tone generator 45 is made up of a pair of discs mounted to the body 11 by means of a fixed pin 53. A resonator 43 is arranged between adjacent tone generators 45 and provided with an internal space 51. The space 51 communicates with the outside air via an opening 49. The openings 49 may be directed to the neighboring tone generators 45 also. Like the foregoing embodiment, the openings 49 may be selectively closable by a proper cover such as the slider 23 shown in FIG. 2.

Figure 5:
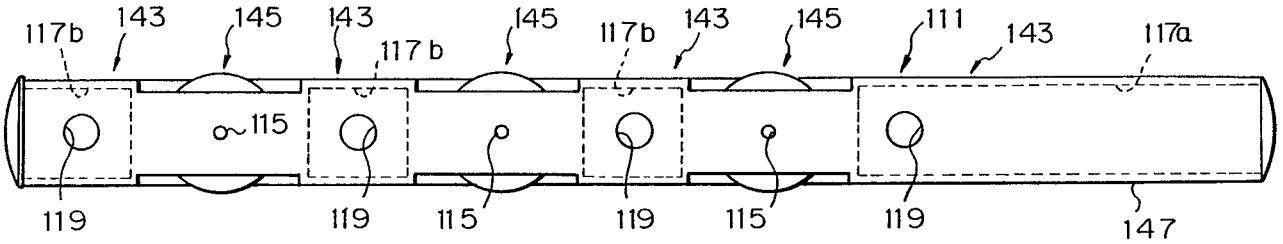

In the case of the foregoing embodiments, the internal spaces 17 of different resonators are substantially same in their capacity. FIG. 5 shows an embodiment in which internal spaces of different resonators have different capacities. More specifically, a stick-type jingle includes an elongated body 111 and a holder 147 formed near one end of the body 111. The jingle further includes three sets of tone generators 145 and four sets of resonators 143. Each tone generator 145 includes a pair of metallic discs monted to the body 111 by means of a fixed pin 115. Each resonator 143 includes an internal space 117 communicating with the outside air via an opening 119. The space 117*a* of the resonator 143 in the area of the holder 147 is larger in capacity than other three spaces 117*b*. Resonators of different capacities have different inherent resonant frequencies and, as a consequence, more colourful resonance can be obtained during performance of the jingle when compared with the foregoing embodiments.

Figure 6:
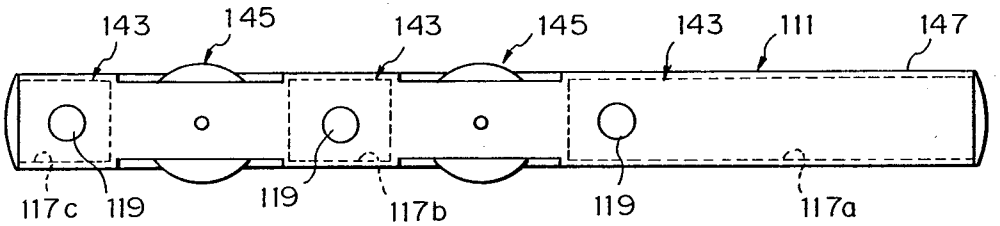
Figure 7:
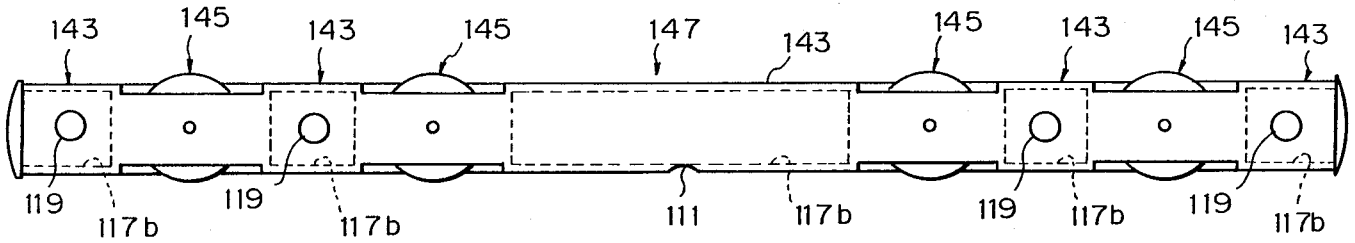

The position having the space of the larger capacity is not limited to the illustrated one. For example, the space 117 of the larger capacity may be located between a pair of spaces 117 having the smaller capacity. Instead of the spaces having two different capacities, spaces of three or more different capacities may be combined too. One example is shown in FIG. 6, in which the jingle includes two sets of tone generators 145 in combination with three sets of resonators 143. The resonator 143 in the area of the holder 147 has a space 117*a* of the largest capacity and the resonator 143 near the distal end has a space 117c of the smallest capacity. In the case of the stick-type jingle shown in FIG. 7, two sets of tone generators 145 in combination with two sets of resonators 143 are arranged on each longitudinal side of a central holder 147 in which a central resonator 143 is formed. The central resonator 143 has an inner space 117*a* larger in capacity than inner spaces 117*b* of other resonators 143.

Needless to say, such variations are applicable to circular jingles and other like musical instruments too.

Figure 9:
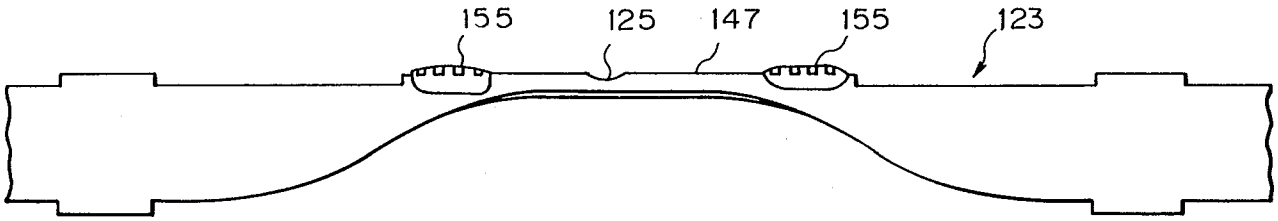
FIG. 9 is a side view, partly removed, of a slider well used for the jingle shown in FIG. 7, and FIGS. 10 and 11 are sectional side views of the sixth and seventh embodiments of the musical instrument in accordance with the present invention directed to a tomtom.
Figure 8:
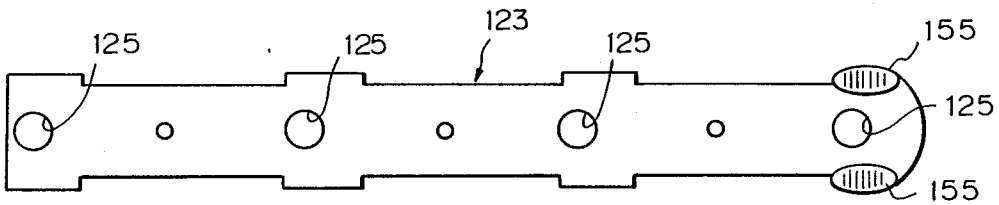
FIG. 8 is a plan view of a slider well used for the jingle shown in FIG. 5.

FIG. 8 depicts a variation of the slider well combined with the jingle shown in FIG. 5. Like the one shown in FIG. 1, the slider 123 includes aligned openings 125 for selective communication of the inner spaces 117 with the outside air. On the holder side end, the slider 123 is provided with a pair of diametrically opposed projections 155 for easy manual operation. A slider 123 shown in FIG. 9 is well used for the jingle shown in FIG. 7. In this case, two projections 155 are formed in a spaced longitudinal alignment in the area of the central holder 147.

Figure 10:
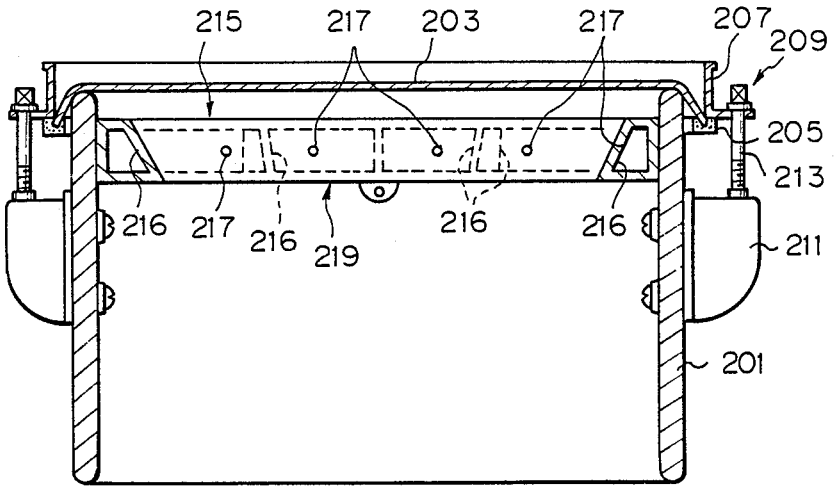

The other embodiment of the musical instrument in accordance with the present invention directed to a tomtom is shown in FIG. 10, in which the tomtom includes a cylindrical stem 201 one end of which is closed by a head 203, a tone generator. The other end of the stem 201 is left open. The head 203 is rimmed by a head collar 205 which is larger in diameter than the stem 201 and pressed downwards by a hoop 207. The hoop 207 is provided at its bottom with an outer flange which is locally accompanied with a head fastener unit 209. More specifically, the head fastener unit 209 includes a bracket 211 attached to the outer face of the stem 201 and a turning bolt 213 standing upwards from the bracket 211 for fastening the hoop 207. An annular hollow box 215 is attached to the inner face of the stem 201 at a level near the head 203. The box 215 includes a plurality of circumferentially arranged, independent inner spaces 216 of an equal capacity. Each space 216 has an opening 217 directed towards the center of the stem 201 for communication of the space 216 with the outside air. Each space 216 in combination with its opening forms a Helmholtz's resonator 219.

As the head 203 is beaten, the resonators 219 resonate with vibrations of the head 203.

Figure 11:
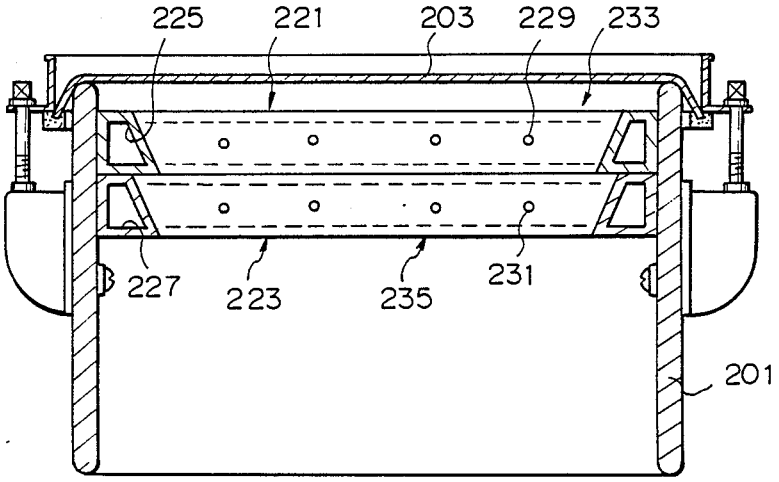

In the case of the embodiment shown in FIG. 11, resonators are arranged in two tiers inside the stem 201 of a tomtom. More specifically, two annular boxes 221 and 223 are vertically superposed inside the stem 201 of the tomtom. The boxes 221 and 223 are provided with a plurality of inner spaces 225 and 227 of different capacities, respectively. Each space is provided with openings 229 or 231 directed towards the center of the stem 201. Thus, each space 225 with its openings 229 forms one resonator 233 and each space 227 with its openings 231 forms another resonator 235. These resonators 233 and 235 are responsive to tones of different frequencies.

We claim:

1. A musical instrument which comprises idiophones or membranophones comprising, a body, at least one tone generator coupled to said body, and a plurality of slide openable resonant chambers arranged in the vicinity of said tone generator, said resonant chambers each having an inner space communicating with the outside air via at least one opening.

2. A musical instrument as claimed in claim 1 further comprising, slide means coupled to said body for selectively closing said at least one opening of said inner space, said slide means having openings at positions corresponding to said at least one opening of said resonator.

3. A musical instrument as claimed in claim 2 wherein said slide means includes projection means for operation of said slide means.

4. A musical instrument as claimed in claims 1 or 2 wherein said resonant chambers have equal resonant frequencies.

5. A musical instrument as claimed in claims 1 or 2 wherein said resonant chambers have resonant frequencies which are different from each other.

* * * * *